US007823698B2

(12) United States Patent
Cano et al.

(10) Patent No.: US 7,823,698 B2
(45) Date of Patent: Nov. 2, 2010

(54) THREE STAGE MAST

(75) Inventors: Artemio V. Cano, Oxnard, CA (US); Aaron Alls, Ventura, CA (US); Mike Wiggins, Thousand Oaks, CA (US)

(73) Assignee: Wiggins Light Co., Inc., Oxnard, CA (US)

( * ) Notice: Subject to any disclaimer, the term of this patent is extended or adjusted under 35 U.S.C. 154(b) by 146 days.

(21) Appl. No.: 11/832,522

(22) Filed: Aug. 1, 2007

(65) Prior Publication Data

US 2009/0032338 A1 Feb. 5, 2009

(51) Int. Cl.
*B66F 9/06* (2006.01)

(52) U.S. Cl. ..... 187/226; 187/227; 187/229; 187/234

(58) Field of Classification Search ..... 187/226, 187/229, 230, 233–236, 227
See application file for complete search history.

(56) References Cited

U.S. PATENT DOCUMENTS

| | | | | | |
|---|---|---|---|---|---|
| 1,977,815 | A | | 10/1934 | Abbe | |
| 2,883,003 | A | | 4/1959 | Arnot | |
| 3,172,500 | A | | 3/1965 | Dolphin et al. | |
| 3,589,541 | A | | 6/1971 | Melin | |
| 3,774,726 | A | * | 11/1973 | Bredberg | 187/223 |
| 3,774,727 | A | * | 11/1973 | Berkestad | 187/226 |
| 3,786,902 | A | * | 1/1974 | Ramsey | 187/227 |
| 3,841,442 | A | | 10/1974 | Erickson et al. | |
| 3,968,859 | A | * | 7/1976 | Ehrhardt | 187/228 |
| 4,015,686 | A | * | 4/1977 | Bushnell, Jr. | 182/148 |
| 4,059,172 | A | | 11/1977 | Stedman | |
| 4,261,438 | A | * | 4/1981 | Olson | 187/227 |
| 4,307,792 | A | | 12/1981 | Benson et al. | |
| 4,421,208 | A | * | 12/1983 | Robinson, Jr. | 187/227 |
| 4,467,893 | A | | 8/1984 | Hobson | |
| 4,476,960 | A | * | 10/1984 | Yarris | 187/226 |
| 4,600,084 | A | * | 7/1986 | Ray | 187/226 |
| 5,326,217 | A | | 7/1994 | Simpson et al. | |
| 5,328,321 | A | * | 7/1994 | Moffett et al. | 414/631 |
| 5,374,156 | A | | 12/1994 | Simpson et al. | |
| 5,549,437 | A | | 8/1996 | Kishi | |
| 5,984,050 | A | * | 11/1999 | Ronald | 187/226 |
| 2005/0036864 | A1 | | 2/2005 | O'Keeffe | |

FOREIGN PATENT DOCUMENTS

| | | |
|---|---|---|
| GB | 2077224 A | 12/1981 |
| JP | 50-130124 | 5/1977 |

* cited by examiner

*Primary Examiner*—Evan H Langdon
(74) *Attorney, Agent, or Firm*—Kelly Lowry & Kelley, LLP

(57) ABSTRACT

The present invention is directed to an apparatus and method for raising and lowering a three-stage forklift mast assembly having a reduced overall lowered height. A first linkage system on the outer and middle masts creates a 2:1 movement ratio of the middle mast with respect to movement of a piston arm in the first linkage system. A second linkage system on the middle and inner masts creates a 2:1 movement ratio of the inner mast with respect to the movement of the middle mast and an overall 4:1 movement ratio with respect to the movement of the piston arm in the first linkage system. A third linkage system on the inner mast creates a 2:1 movement ratio of a set of forks on the inner mast with respect to the movement of a piston arm in the third linkage system, allowing free lift of the forks.

17 Claims, 5 Drawing Sheets

THREE STAGE MAST

BACKGROUND OF THE INVENTION

The present invention relates generally to the industrial vehicle field and more particularly, to a forklift truck providing both extensive positive (upward above ground level) and negative (downward below ground level) lift capabilities such as required of, for example, "marina" type lifts.

Certain applications of forklift trucks require an upright construction that is capable of providing both positive and negative lift from a ground or support level position. For example, such a forklift truck is particularly useful for handling boats in and around marinas. The market for such a forklift truck has significantly increased in recent years with ever more and more people owning and operating pleasure boats.

Forklift trucks may be used in warehouses or other structures where loads must be raised above ground level for storage or lowered below ground level for various reasons. In the marina setting, forklift truck may be utilized to both lower boats into and raise boats out of the water from an elevated dock or the like. Similarly, such forklift trucks may be utilized to raise boats for positioning well above the ground in an overhead storage rack.

Heretofore, forklift truck designs have been developed for this purpose. One such representative design is disclosed in U.S. Pat. No. 3,841,442 to Erickson et al. The forklift truck disclosed in the Erickson et al patent includes outer, intermediate and inner, telescoping mast sections with a load carriage elevatable on the inner mast section. The forklift truck also includes a pair of actuator cylinders and cooperating chains. These cylinders and chains are connected to the mast sections so that one cylinder and chain set is adapted to elevate the load carriage and the inner mast section above ground level. The other cylinder and chain set is adapted to lower below ground level the load carriage and inner and intermediate mast sections together as a unit in the outer mast section.

Another representative design is disclosed in U.S. Pat. No. 5,326,217 to Simpson et al. The forklift truck disclosed in Simpson et al. includes first, second and third telescoping mast sections. Each mast section is formed from pairs of laterally spaced and interconnected I-beam rails. A carriage assembly is mounted for movement along a path on the third mast section. Rollers are provided for mounting the mast sections and carriage assembly together for relative movement. A drive assembly connected to the upright assembly and carriage assembly serves to move the carriage assembly at a first, relatively slow speed over a first portion of the movement path and at a second relatively fast speed over a second portion of the movement path. More particularly, the drive assembly includes twinned actuating cylinders for operatively connecting the first and second mast sections. A first dead chain operatively connects the first and third mast sections. A second dead chain operatively connects the second mast section and the carriage assembly. A guide rod is connected to one end of the second dead chain and a guide sleeve is mounted to the second mast section. The guide rod is received in free sliding engagement in the guide sleeve so as to prevent relative movement between the carriage assembly and the third mast section at all times when the carriage assembly is in a negative lift configuration, that is, below ground level. A stop is mounted to the distal end of the guide rod. When the carriage assembly is in a positive lift configuration, that is, above ground level, the stop abuts against and engages the guide sleeve. This engagement causes relative movement of the carriage assembly along the third mast section when in any positive lift configuration.

A forklift mast assembly typically consists of two or more sections of track nestably engaged in a vertical orientation for elevating a set of forks above ground level. Such elevation is typically achieved through the action of systems including cylinders, pulleys and/or chains. Through varying configurations of cylinders, pulleys and/or chains, prior art forklift mast assemblies have been able to achieve varying ratios of relative movement of the track sections and forks.

Forklift trucks must be capable of entering and exiting doorways on structures in which loads are to be stored. The mast assembly must be sufficiently low to permit entrance and egress through the doorways on the structures. Certain configurations with improved height characteristics have been able to achieve negative-lift or the lowering of the forks below the level of the wheels on the truck. Other assemblies have been able to achieve free-lift or the free movement of the forks along the track section without increasing the overall height of the lowered mast assembly.

These prior art assemblies and configurations have been plagued with drawbacks such as an overall lowered height that is too high for entry into certain structures. Certain configurations have also been unable to achieve the combination of free-lift and negative-lift. Other configurations, while able to achieve a lower overall height have done so by adding additional track sections resulting in an overall heavier mast assembly.

Therefore, there is a need for a forklift mast assembly that provides a lower overall lowered height with fewer track sections while providing negative-lift and free-lift. The present invention fulfills these needs and provides other related advantages.

SUMMARY OF THE INVENTION

The present invention is directed to a forklift mast assembly comprising an outer mast, a middle mast and an inner mast, each mast slidably and nestably engaging an adjacent mast. The outer mast is affixed to a forklift truck.

A first linkage system including a cylinder assembly, a pulley and a chain is associated with the outer and middle masts. The cylinder assembly is mounted on the outer mast. The chain is fixed at opposite ends to the outer and middle masts and therebetween engages the pulley on the cylinder assembly. This configuration of the first linkage system achieves a 2:1 movement ratio of the middle mast to the cylinder assembly. The first linkage system may comprise a pair of pulleys and a pair of chains mounted on either side of a centerline of the forklift mast assembly.

A second linkage system comprising a chain and a pulley is associated with the middle and inner masts. The chain is fixed at opposite ends to the outer and inner masts and therebetween engages the pulley on the middle mast. This configuration of the second linkage system achieves a 4:1 movement ratio of the inner mast with respect to the cylinder assembly of the first linkage system. The second linkage system may comprise a pair of chains and a pair of pulleys mounted adjacent to opposite sides of the middle mast.

A fork or pair of forks is slidably and nestably engaged with the inner mast. A third linkage system comprising a cylinder assembly, a chain and a pulley is associated with the inner mast and forks. The cylinder assembly of the third linkage system is mounted on the inner mast. The chain of the third linkage system is fixed at opposite ends to the inner mast and the fork and therebetween engages the pulley on the cylinder assembly of the third linkage system. The third linkage system may comprise a pair of chains and a pair of pulleys each mounted on opposite sides of a centerline of the forklift mast assembly.

The cylinder assemblies in the first and third linkage systems each have a piston arm upon which the pulley of that system is mounted. Each of the first and third linkage systems are actuated separately through the application of pneumatic or hydraulic pressure on the cylinder assemblies of each system.

The present invention is also directed to a process for raising and lowering a three-stage, nested forklift mast assembly to achieve a 4:1 lift ratio. This process includes the step of actuating a cylinder assembly mounted on an outer mast such that a pulley mounted on the cylinder assembly engages an intermediate portion of a chain affixed at its ends to the outer mast and a middle mast, thereby moving the middle mast in a 2:1 movement ratio to the movement of the cylinder assembly. After this actuation, an intermediate portion of another chain is engaged using a pulley mounted on the middle mast, the chain affixed at its ends to the outer mast and an inner mast, thereby moving the inner mast in a 4:1 movement ratio to the movement of the cylinder assembly. In addition, a set of forks on the inner mast is raised by actuating a fork cylinder assembly mounted on the inner mast. A pulley mounted on the fork cylinder assembly engages an intermediate portion of a fork chain affixed at its ends to the inner mast and the set of forks. This action moves the set of forks in a 2:1 movement ratio to the movement of the fork cylinder assembly and independent of the movement of the forklift mast.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
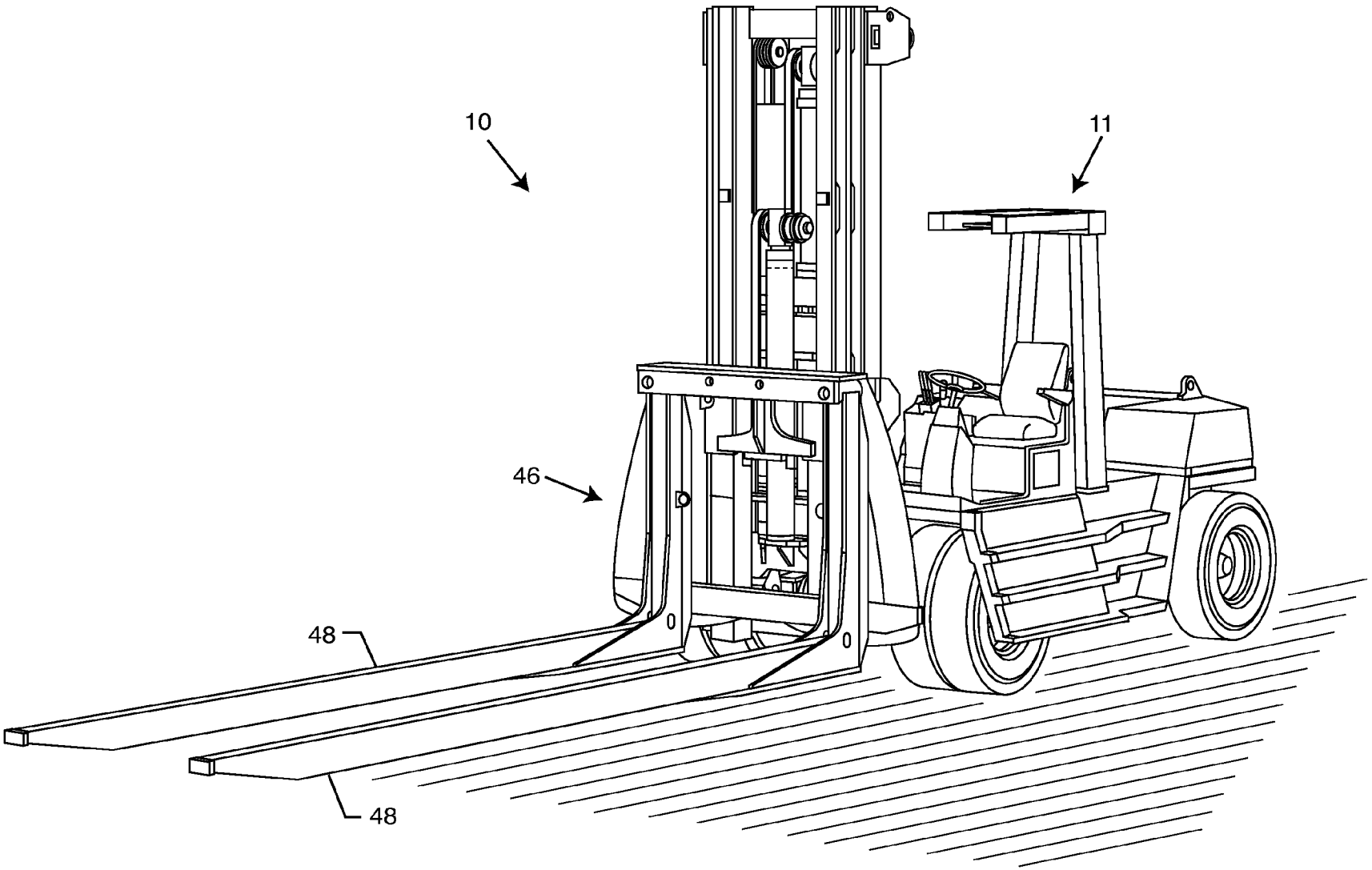
FIG. 1 is a perspective view of a forklift truck and forklift mast assembly of the present invention.
Figure 2:
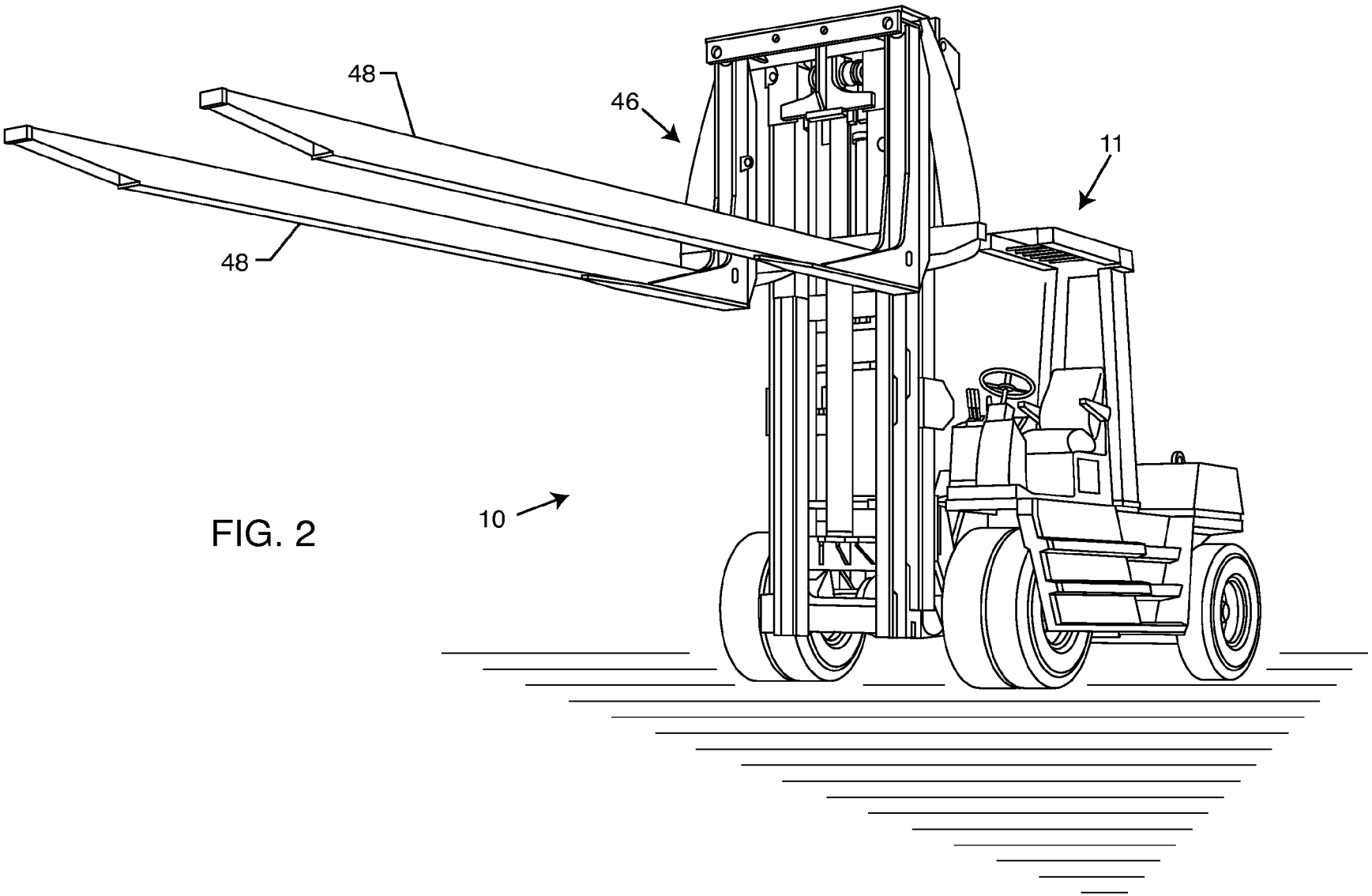
FIG. 2 is a perspective view of the same forklift truck and forklift mast assembly illustrating free-lift.
Figure 3:
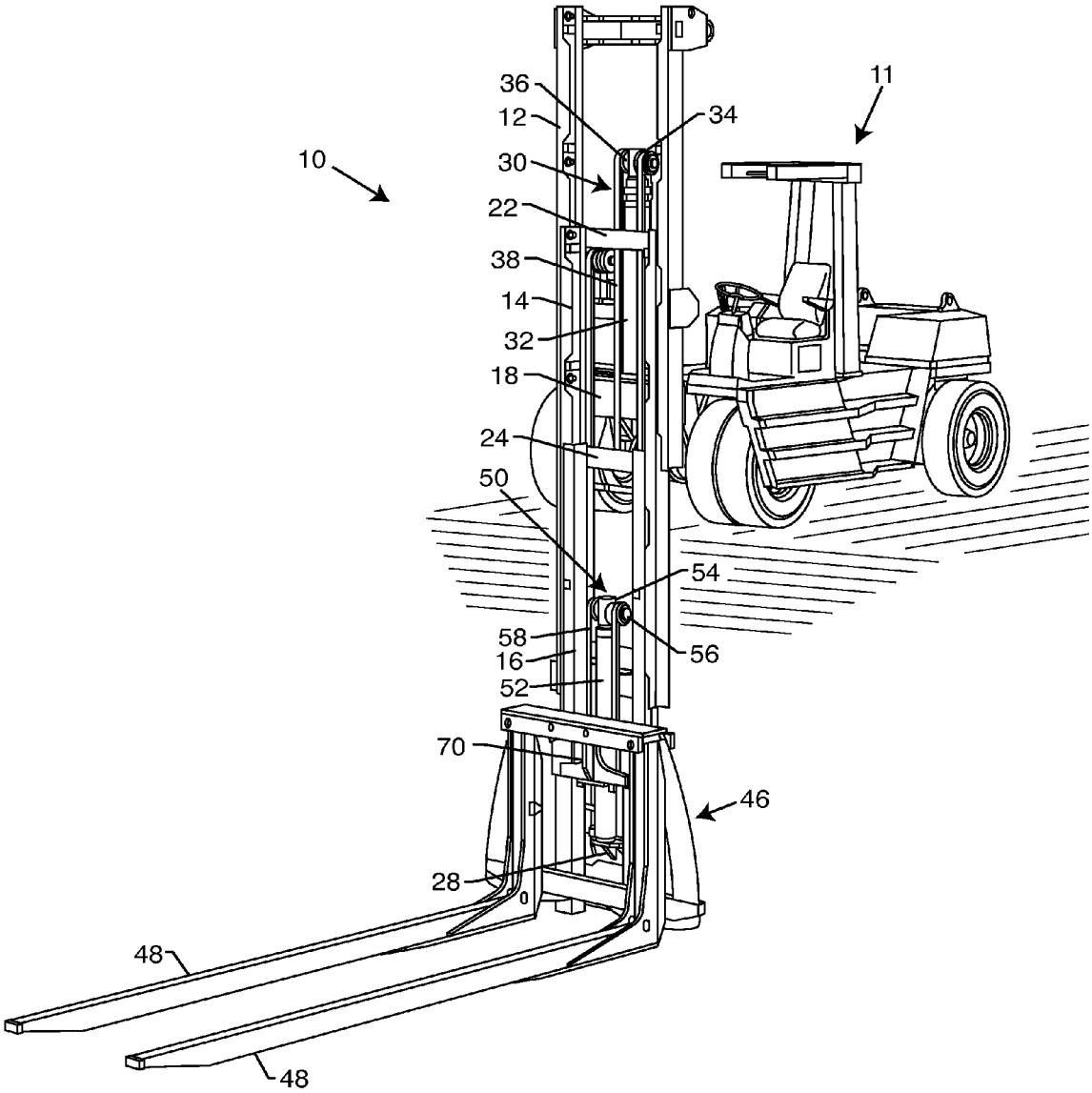
FIG. 3 is a perspective view of the same forklift truck and forklift mast assembly illustrating negative-lift.
Figure 4:
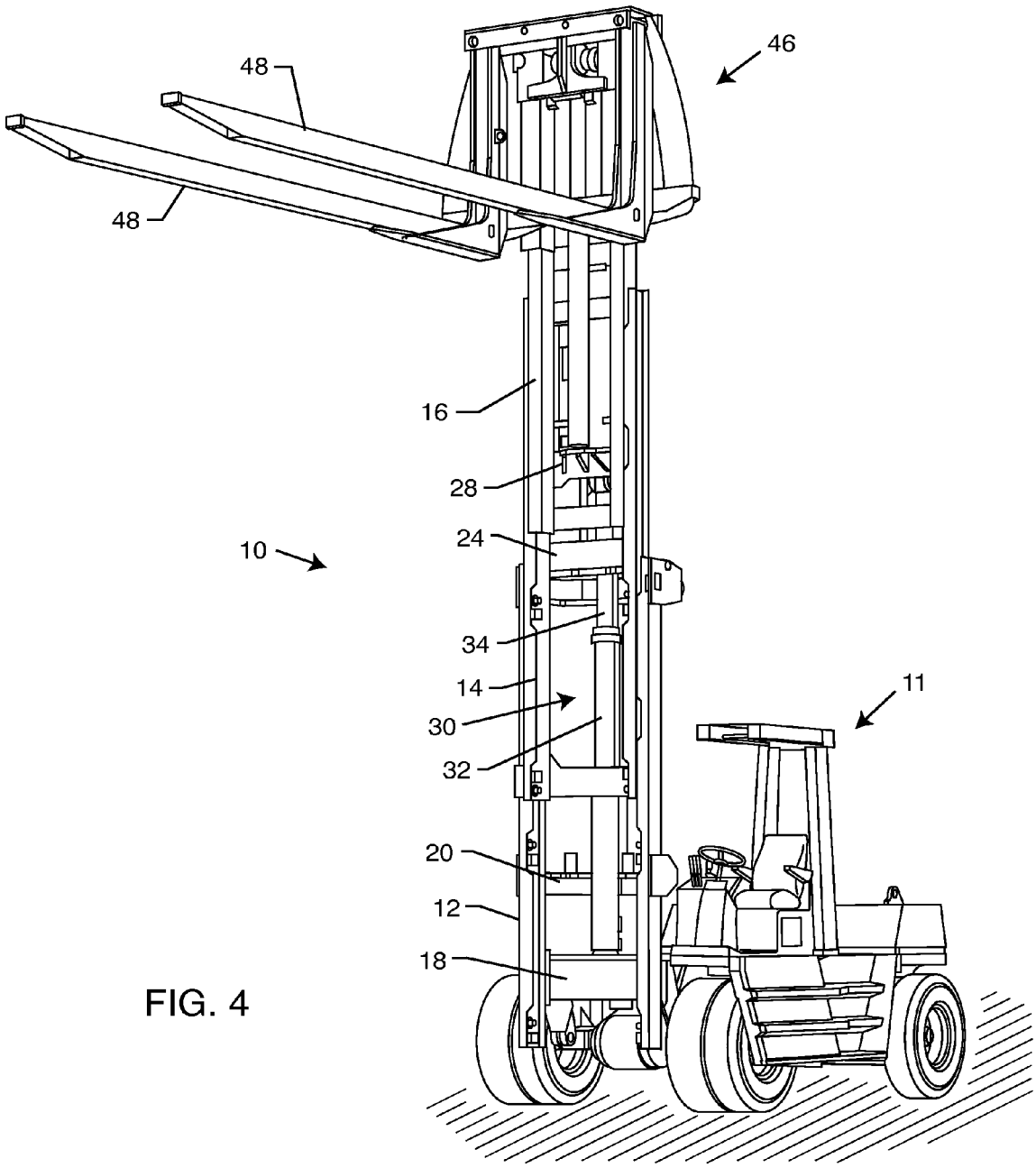
FIG. 4 is a perspective view of the same forklift truck and forklift mast assembly illustrating positive lift.
Figure 5:
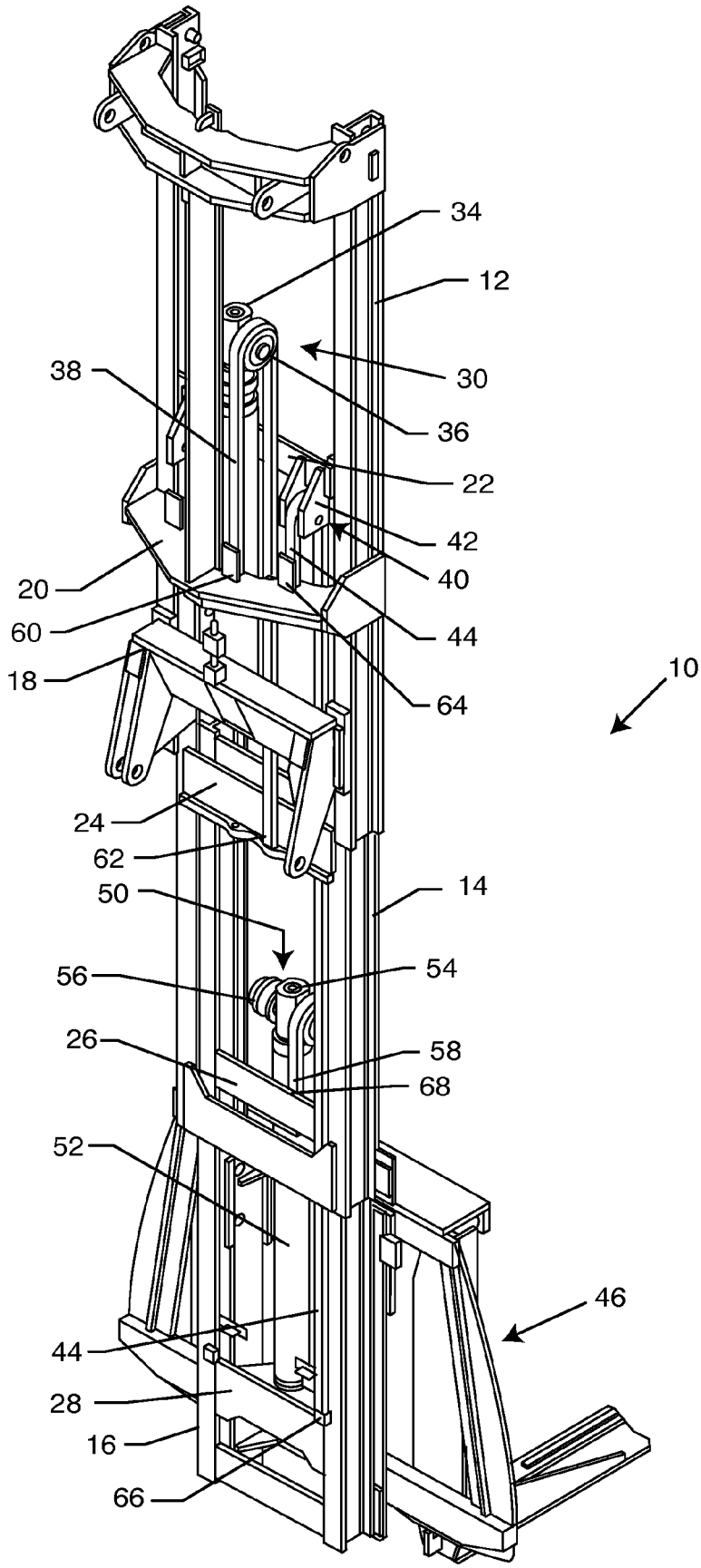
FIG. 5 is a rear perspective of the forklift mast assembly illustrating negative lift.

As shown in the drawings for purposes of illustration, the present invention is concerned with a forklift mast assembly, generally referred to in FIGS. 1 through 5 by reference number 10. The forklift mast assembly 10 consists of an outer mast 12, a middle mast 14, and an inner mast 16. Each of the masts 12, 14, 16 are nestably and slidably engaged with one another. The outer mast 12 is affixed to a forklift truck 11.

Each of the masts 12, 14, 16 comprise generally rectangular frames having upper, lower and/or middle cross support members. Cross support members relevant to the present invention are as follows: the outer mast 12 includes a lower crossbar 18 and a middle crossbar 20; the middle mast 14 includes an upper crossbar 22 and a middle crossbar 24; the inner mast 16 includes a middle crossbar 26 and a lower crossbar 28. Each mast section may have cross support members in addition to those identified here. In addition, a cross support member identified as upper, middle or lower only approximates the position on the mast section where the cross support member is located. So long as one of these cross support members is in approximately the upper, middle or lower position on the mast section the present invention will operate as intended.

A first linkage system 30 comprising a cylinder assembly 32, a piston arm 34, a pulley 36 and a chain 38 is associated with the outer and middle masts 12, 14. The cylinder assembly 32 is mounted on the lower crossbar 18 of the outer mast 12. The cylinder assembly 32 is oriented vertically and the piston arm 34 extends from the cylinder assembly 32 moving upward when extended and downward when contracted. The chain 38 is affixed at one end 60 to the middle crossbar 20 of the outer mast 12 and at its other end 62 to the middle crossbar 24 of the middle mast 14. The chain 38 is looped over the pulley 36 which is mounted on the piston arm 34.

Preferably the cylinder assembly 32 is mounted in the center of the lower crossbar 18 so that it is centered between the sides of the generally rectangular outer mast 12. In the above description only one pulley and chain was provided for. If there is only one pulley and chain, such pulley and chain are preferably positioned as close as possible to the center of the generally rectangular outer mast 12. In a preferred embodiment, there is a pair of pulleys 36 located on either side of the cylinder assembly 32 such that each one is equidistant from the center of the outer mast 12. Two chains 38 are then run in parallel fashion over each pulley wherein each chain mirrors the position of the other chain. This configuration provides for a more uniform exertion of force on the movement of the middle mast 14.

When the outer and middle masts 12, 14 are in alignment, the piston arm 34 is in a baseline position which is approximately halfway between being fully extended and fully contracted. As the piston arm 34 is extended, the chain 38 runs over the pulley 36 in one direction, thereby raising the middle mast 14. As the piston arm 34 is contracted, the chain 38 runs over the pulley 36 in the other direction, thereby lowering the middle mast 14. The contraction of the piston arm 34 brings the middle mast 14 back into alignment with the outer mast 12. As the piston arm 34 is contracted beyond the baseline position, the middle mast 14 is lowered beyond the fixed position of the outer mast 12. Because of the configuration of the first linkage assembly 30, the middle mast 14 moves in a 2:1 lift ratio with respect to the movement of the piston arm 34.

A second linkage system 40 comprising a pulley 42 and a chain 44 is associated with the middle and inner masts 14, 16. The pulley 42 is attached to the upper crossbar 22 of the middle mast 14. The chain 44 is attached at one end 64 to the middle crossbar 20 of the outer mast 12 and at its other end 66 to the lower crossbar 28 of the inner mast 16. The chain 44 is looped over pulley 42. The second linkage system 40 is configured such that6 its baseline position is when the middle mast 14 is aligned with the outer mast 12.

Preferably the pulley 42 is positioned adjacent one side of the generally rectangular middle mast 14. As with the first linkage system 40, in a preferred embodiment a pair of pulleys 42 and a pair of chains 44 comprise the second linkage system 40. These pair of pulleys 42 and pair of chains 44 are adjacent opposite sides of the middle mast 14. In this embodiment one pulley 42 and one chain is adjacent the right side of the middle mast 14 and the other pulley 42 and other chain 44 is adjacent the left side of the middle mast 14. Again, this configuration of a pair of pulleys and a pair of chains results in a more uniform exertion of force upon the inner mast 16.

When the action of the first linkage system 30 causes the middle mast 14 to move either up or down, the second linkage system 40 causes the inner mast 16 to move in response. Since the chain 44 is fixed to the outer mast 12 at one end, as the middle mast 14 is raised the chain 44 runs over the pulley 42 in one direction, causing the inner mast 16 to rise in response. Similarly, as the middle mast 14 is lowered the chain 44 runs over the pulley 42 in the opposite direction, causing the inner mast 16 to lower in response. The configuration of the second linkage system 40 causes the inner mast 16 to move in a 2:1 lift ratio to the movement of the middle mast 14.

Combining the movement ratio of the second linkage system 40 with the movement ratio of the first linkage system, the inner mast 16 moves in a 4:1 lift ratio to the movement of the piston arm 34 of the first linkage system 30. This 4:1 lift ratio is an improvement over that which existed in the prior art. This improved lift ratio requires less overhead for the expansion of the piston arm to achieve raising distances similar to prior art mast assemblies. A mast assembly with a smaller baseline height can achieve similar or even greater raising or lowering distances than mast assemblies having longer mast sections and less efficient lift ratios.

A set of forks 46 is mounted on the inner mast 16. The set of forks 46 may consist of a single arm or multiple arms 48. Preferably the set of forks 46 consists of two arms 48 as shown in the drawings. A third linkage system 50 comprising a fork cylinder assembly 52, a piston arm 54, a pulley 56 and a fork chain 58 is associated with the inner mast 16 and set of forks 46. The fork cylinder assembly 52 is mounted on the lower crossbar 28 of the inner mast 16. The fork cylinder assembly 52 is oriented vertically and the piston arm 54 extends from the fork cylinder assembly 52 moving upward when extended and downward when contracted, The fork chain 58 is affixed at one end 68 to the middle crossbar 26 of the inner mast 16 and at its other end 70 to the set of forks 46. The fork chain 58 is looped over the pulley 56 which is mounted on the piston arm 54.

Preferably the fork cylinder assembly 52 is mounted on the center of the lower crossbar 28 so that it is positioned as near as possible to the center of the generally rectangular outer mast 16. Similarly the pulley 56 and fork chain 58 are also mounted as close as possible to the center of the inner mast 16. As with the other linkage systems a preferred embodiment comprises two pulleys 56 and two fork chains 58. These pair of pulleys 56 and pair of fork chains 58 are mounted on opposite sides of the fork cylinder assembly 52 such that their positions mirror each other. Again this configuration provides for more uniform application of force on the set of forks 46.

This third linkage system 50 operates in a manner similar to the first linkage system 30 described above. When the set of forks 46 are aligned with the bottom of the inner mast 16, the piston arm 54 is in a baseline position. As the piston arm 54 is extended, the fork chain 58 runs over the pulley 56 in one direction, thereby raising the set of forks 46 with respect to the inner mast 16. As the piston arm 54 is contracted, the fork chain 58 runs over the pulley 56 in the opposite direction, thereby lowering the set of forks 46 with respect to the inner mast 16. The contraction of the piston arm 54 brings the set of forks 46 back into alignment with the bottom of the inner mast 16. As the piston arm 54 is contracted beyond the baseline position, the set of forks 46 is lowered beyond the position of the inner mast 16. Because of the configuration of the third linkage assembly 50, the set of forks moves in a 2:1 lift ratio with respect to the movement of the piston arm 54. Because the third linkage system 50 is independent of any other linkage system in the assembly 10, the set of forks 46 is capable of free lift, i.e., movement of the set of forks 46 along the inner mast 16 without moving the rest of the assembly 10.

The three-stage mast and the first, second and third linkage systems work together to result in a smooth and efficient elevating and lowering of the mast sections and forks. When the first linkage system 30 is activated, the chain 38 is drawn tight. As the piston arm 34 extends the pulley 36 raises and the chain 38 is forced to move over the pulley 36 in one direction. Since the chain 38 is affixed at one end to the outer mast 12, which is fixed to the truck 11, that end of the chain 38 cannot move. Therefore the other end of the chain 38 which is affixed to the middle mast 14 must move, thereby raising the middle mast 14 with respect to the stationary outer mast 12.

As the middle mast 14 is raised, the second linkage system 40 is activated. When the second linkage system 40 is activated the pulley 42 draws the chain 44 tight. Since the chain 44 is fixed at one end to the outer mast 12 which is fixed to the truck 11 that end of the chain 44 cannot move. Therefore, as the pulley 42 is moved upward by the movement of the middle mast 14, the other end of the chain 44 which is affixed to the inner mast 16 must move thereby raising the inner mast 16.

Because of the configuration of the first linkage system 30 the middle mast 14 moves in a 2:1 ratio to the movement of the cylinder assembly 32. Similarly, because of the configuration of the second linkage system 40 the inner mast 16 moves in a 2:1 movement ratio to the middle mast 14. Therefore as the middle mast is moving in a 2:1 movement ratio to the cylinder assembly 32 and the inner mast 16 is moving in a 2:1 movement ratio to the middle mast 14, the inner mast 16 moves in a 4:1 movement ratio to the cylinder assembly 32.

Independent of the action of the first linkage system 30 and the second linkage system 40 the third linkage system 50 controls movement of the forks 46. The third linkage system 50 is independent of the other linkage systems because there is no interconnection. The fork chain 58 of the third linkage system 50 is affixed at one end to the inner mast 16 and at the other end to the forks 46. This fork chain 58 is engaged by the pulley 56 on the cylinder assembly 52 which is mounted on the inner mast 16. Because of this isolation of the third linkage system 50 the forks 46 may be raised and lowered without movement of any of the mast sections.

Just as extending any of the piston arms 34, 54 causes the linkage systems 30, 40, 50 to raise the mast sections 14, 16 or forks 46 affixed thereto lowering those same piston arms 34, 54 results in a lowering of the appropriate mast section 14, 16 or forks 46. Such lowering occurs due to the weight of the connected mast section 14, 16 or forks 46. This means that the lowering action does not lower those elements under force but allows gravity to simply pull those elements down as the pressure which held the piston arms 34, 54 extended is released.

Although an embodiment has been described in detail for purposes of illustration, various modifications may be made without departing from the scope and spirit of the invention. Accordingly, the invention is not to be limited, except as by the appended claims.

What is claimed is:

1. A forklift mast assembly, comprising:

a three-stage mast consisting of an outer mast, a middle mast, and an inner mast, each mast slidably and nestably engaging an adjacent mast and configured for positive and negative lift along the length of each mast;

a first linkage system comprising a cylinder assembly mounted on the outer mast and a chain fixed at opposite ends to the outer and middle masts, therebetween engaging a pulley on the cylinder assembly, wherein the first linkage system achieves a 2:1 movement ratio of the middle mast to the cylinder assembly; and a second linkage system comprising a chain fixed at opposite ends to the outer and inner masts, therebetween engaging a pulley on the middle mast, wherein the second linkage system achieves a 4:1 movement ratio of the inner mast to the cylinder assembly.

2. The forklift mast assembly of claim 1, further comprising:

a fork slidably and nestably engaging the inner mast; and a third linkage system comprising a fork cylinder assembly mounted on the inner mast and a fork chain fixed at opposite ends to the inner mast and the fork, therebetween engaging a pulley on the fork cylinder assembly.

3. The forklift mast assembly of claim 2, wherein the fork comprises a pair of forks.

4. The forklift mast assembly of claim 1, wherein the cylinder assembly of the first linkage system has a piston arm on which the pulley of the first linkage system is mounted.

5. The forklift mast assembly of claim 2, wherein the fork cylinder assembly of the third linkage system has a piston arm on which the pulley of the third linkage system is mounted.

6. The forklift mast assembly of claim 1, wherein the first linkage system is actuated through the application of pneumatic or hydraulic pressure on the cylinder assembly of the first linkage system.

7. The forklift mast assembly of claim 2, wherein the third linkage system is actuated through the application of pneumatic or hydraulic pressure on the fork cylinder assembly of the third linkage system.

8. The forklift mast assembly of claim 1, wherein the first linkage system comprises a pair of pulleys and a pair of chains positioned on either side of a centerline of the forklift mast assembly and the second linkage system comprises a pair of pulleys and a pair of chains each positioned adjacent to an outer edge of the middle mast.

9. The forklift mast assembly of claim 2, wherein the third linkage system comprises a pair of pulleys and a pair of chains each positioned on either side of a centerline of the forklift mast assembly.

10. A forklift mast assembly, comprising:

a three-stage mast consisting of an outer mast, a middle mast, and an inner mast, each mast slidably and nestably engaging an adjacent mast and configured for positive and negative lift along the length of each mast;

a pair of forks slidably and nestably engaging the inner mast;

a first linkage system comprising a cylinder assembly mounted on the outer mast and a chain fixed at opposite ends to the outer and middle masts, therebetween engaging a pulley on the cylinder assembly, wherein the first linkage system achieves a 2:1 movement ratio of the middle mast to the cylinder assembly;

a second linkage system comprising a chain fixed at opposite ends to the outer and inner masts, therebetween engaging a pulley on the middle mast, wherein the second linkage system achieves a 4:1 movement ratio of the inner mast to the cylinder assembly; and a third linkage system comprising a fork cylinder assembly mounted on the inner mast and a fork chain fixed at opposite ends to the inner mast and the pair of forks, therebetween engaging a pulley on the fork cylinder assembly.

11. The forklift mast assembly of claim 10, wherein the cylinder assembly of the first linkage system has a piston arm on which the pulley of the first linkage system is mounted and the fork cylinder assembly of the third linkage system has a piston arm on which the pulley of the third linkage system is mounted.

12. The forklift mast assembly of claim 10, wherein the first linkage system and third linkage system are both separately actuated through the application of pneumatic or hydraulic pressure on the cylinder assembly thereof.

13. The forklift mast assembly of claim 10, wherein the outer mast is affixed to a forklift truck.

14. The forklift mast assembly of claim 10, wherein the first linkage system comprises a pair of pulleys and a pair of chains positioned on either side of a centerline of the forklift mast assembly and the second linkage system comprises a pair of pulleys and a pair of chains each positioned adjacent to an outer edge of the middle mast.

15. The forklift mast assembly of claim 10, wherein the third linkage system comprises a pair of pulleys and a pair of chains each positioned on either side of a centerline of the forklift mast assembly.

16. A process for raising and lowering a three-stage, nested forklift mast assembly to achieve a 4:1 lift ratio, comprising the steps of:

actuating a cylinder assembly mounted on an outer mast such that a pulley mounted on the cylinder assembly engages an intermediate portion of a chain affixed at its ends to the outer mast and a middle mast, thereby moving the middle mast in a 2:1 movement ratio to the movement of the cylinder assembly from full positive to full negative lift; and engaging an intermediate portion of another chain using a pulley mounted on the middle mast, the chain affixed at its ends to the outer mast and an inner mast, thereby moving the inner mast in a 4:1 movement ratio to the movement of the cylinder assembly from full positive to full negative lift.

17. The process of claim 16, further comprising the step of raising a set of forks on the inner mast by actuating a fork cylinder assembly mounted on the inner mast such that a pulley mounted on the fork cylinder assembly engages an intermediate portion of a fork chain affixed at its ends to the inner mast and the set of forks, thereby moving the set of forks in a 2:1 movement ratio to the movement of the fork cylinder assembly and independent of the movement of the forklift mast.

* * * * *